US007293770B2

(12) United States Patent
Edinger

(10) Patent No.: US 7,293,770 B2
(45) Date of Patent: Nov. 13, 2007

(54) SHEET-TRANSPORTING DEVICE HAVING A SUCTION BELT MODULE WITH A BLOWER

(75) Inventor: Holger Edinger, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 371 days.

(21) Appl. No.: 10/785,123

(22) Filed: Feb. 24, 2004

(65) Prior Publication Data

US 2004/0164482 A1 Aug. 26, 2004

(30) Foreign Application Priority Data

Feb. 24, 2003 (DE) ..... 103 07 711

(51) Int. Cl.
*B65H 5/02* (2006.01)

(52) U.S. Cl. ..... 271/276; 271/196; 271/197; 198/689.1

(58) Field of Classification Search ..... 271/196, 271/197, 276; 198/689.1
See application file for complete search history.

(56) References Cited

U.S. PATENT DOCUMENTS 5,133,543 A * 7/1992 Eitel et al. ..... 271/276
5,392,107 A * 2/1995 Paxon et al. ..... 399/361
5,697,606 A 12/1997 Maass
5,779,236 A * 7/1998 Duncan et al. ..... 271/276

FOREIGN PATENT DOCUMENTS

DE 36 07 882 C1 4/1987
DE 40 13 302 A1 10/1991
DE 44 16 286 C2 11/1995

* cited by examiner

*Primary Examiner*—Patrick Mackey
*Assistant Examiner*—Kaitlin S Joerger
(74) *Attorney, Agent, or Firm*—Laurence A. Greenberg; Werner H. Stemer; Ralph E. Locher

(57) ABSTRACT

A device for transporting sheets to a sheet processing machine includes a feed table, and at least one suction belt endlessly revolvable over the feed table. The suction belt is subjectible to vacuum from suction regions of different pressure levels disposed behind one another in a direction of sheet transport and the suction regions are producible by a single vacuum source. The suction belt is formed with through openings, and the feed table is formed with suction openings and ventilation openings, both of which correspond with the through openings formed in the suction belt.

11 Claims, 5 Drawing Sheets

SHEET-TRANSPORTING DEVICE HAVING A SUCTION BELT MODULE WITH A BLOWER

BACKGROUND OF THE INVENTION

FIELD OF THE INVENTION

The invention relates to a sheet-transporting device having a device for adapting or adjusting vacuum in a suction belt feed table of a sheet feeder. At least one suction box is disposed below a sheet transport plane and, as viewed in sheet transport direction, is divided into a plurality of chambers subjectible in common to vacuum.

Transport of an imbricated stream of sheets on the feed table of a feeder of a sheet fed rotary printing press may be divided into three phases.

- The first phase is distinguishable by the sheet being drawn from a sheet pile or stack and not lying with full imbricated length on the belt.
- The second phase is distinguishable by the sheet being underlappingly transported and an imbricated length thereof lying on the belt.
- The third phase is distinguishable by the sheet being transported to the front guide (the leading edge of the sheet no longer being on the belt) and being cut off by the next following sheet.

A greater suction force is necessary in the first and third phases than in the second phase, because the supporting surface of the sheet is smaller in the first and third phases than in the second phase.

It is necessary to provide different vacuum levels beneath the sheet stream in order for the different operating conditions to meet expectations. That can be achieved, on one hand, by employing a plurality of vacuum sources with different vacuum levels or, on the other hand, as is known from the prior art as exemplified in German Patent DE 44 16 286 C2 corresponding to U.S. Pat. No. 5,697,606, by a switching valve which connects the suction chamber of the middle transport region to atmospheric air.

SUMMARY OF THE INVENTION

It is accordingly an object of the invention to provide a sheet-transporting device having a suction belt module with a blower, which overcomes the hereinafore-mentioned disadvantages of the heretofore-known devices of this general type and which has only a single vacuum source, by which the holding force on the sheet in the middle suction region is reduced in comparison with the holding force in the other suction regions.

With the foregoing and other objects in view, there is provided, in accordance with the invention, a device for transporting sheets to a sheet processing machine, in particular a printing press. The sheet-transporting device comprises a feed table, and at least one suction belt endlessly revolvable over the feed table. The suction belt is subjectible to vacuum from suction regions of different pressure levels disposed behind one another in a direction of sheet transport. The suction regions are producible by a single vacuum source. The suction belt is formed with through openings. The feed table is formed with suction openings and ventilation openings, both of which correspond with the through openings formed in the suction belt.

In accordance with another feature of the invention, the suction openings and the ventilation openings are disposed in a second or middle suction region of the feed table.

In accordance with a further feature of the invention, the sheet-transporting device further includes suction boxes disposed in parallel in edge regions of the suction belt for acting upon the suction openings formed in the feed table.

In accordance with an added feature of the invention, the sheet-transporting device further includes suction boxes disposed behind one another in a V shape for acting with vacuum upon the suction openings formed in the feed table.

In accordance with an additional feature of the invention, the ventilation openings formed in the feed table are respectively disposed between the suction boxes.

In accordance with a concomitant feature of the invention, the sheet-transporting device further includes a rotary valve through which a respective suction box of an end suction region is connected to the single vacuum source.

It is of great advantage that the middle region is operated with low vacuum. A reduction in the suction of air from between the sheets and, thereby, in the adhesion of the sheets to one another results. Despite using only one blower, the vacuum in the middle region can be reduced by using simple devices for minimizing the suction area.

One preferred configuration provides for a specific number of openings in the suction belt to have vacuum applied thereto, while the remaining openings have atmospheric air applied thereto. Due to this measure, a holding force is exerted on the sheet only in the region of the openings which have vacuum applied thereto.

Placing ventilation openings in the transport belt between two rows of suction openings prevents the possibility for a vacuum to form in the entire suction belt region.

A second exemplary embodiment provides for the suction boxes in the middle suction belt region to be disposed in a V shape in the direction of transport at a spaced distance from one another. Due to this measure, the openings of the transport belt come alternately into operative contact with the suction holes and the ventilation holes of the feed table. The V-shaped configuration, in this regard, supports the tensioning or stretching of the transport belt transversely to the direction of transport, and produces a centering effect.

Other features which are considered as characteristic for the invention are set forth in the appended claims.

Although the invention is illustrated and described herein as embodied in a sheet-transporting device having a suction belt module with a blower, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
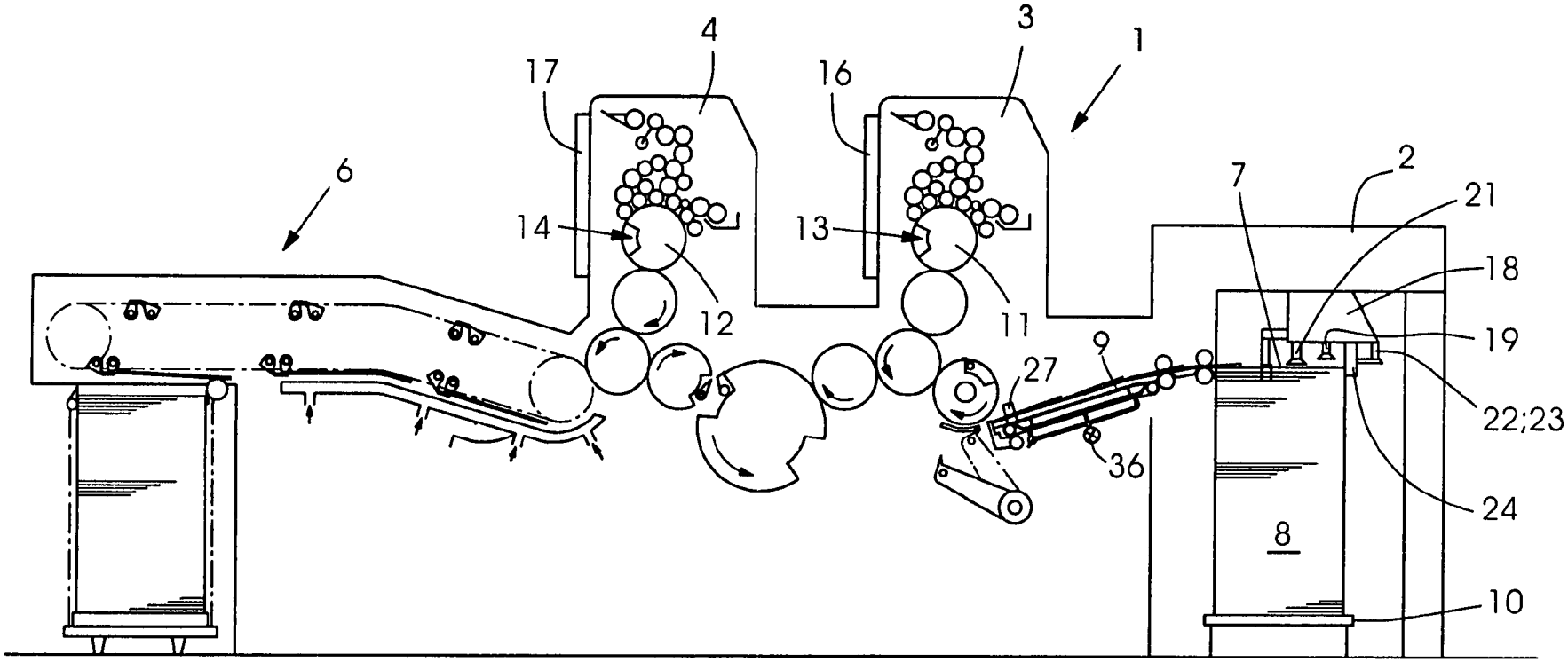
FIG. 1 is a diagrammatic, side-elevational view of a sheet processing printing press incorporating the invention of the instant application.

Referring now to the figures of the drawings in detail and first, particularly, to FIG. 1 thereof, there is seen a rotary printing press 1, e.g. a printing press for processing sheets 7, having a feeder 2, at least one respective printing unit 3 and 4 and a delivery 6. The sheets 7 are removed from a sheet pile or stack 8 and, singly separated or overlapping, i.e., imbricated, are fed over a feed table 9 to the printing units 3 and 4. Each of the printing units 3, 4 is provided in a conventional manner with a respective plate cylinder 11, 12. The plate cylinders 11 and 12 each have a respective device 13 and 14 for fastening flexible printing plates thereon. Furthermore, each plate cylinder 11, 12 has a respective device 16, 17 assigned thereto for effecting a semiautomatic or fully automatic printing-plate change.

The sheet pile or stack 8 lies on a controllably liftable pile or stack plate 10. The removal of the sheets 7 takes place from the top of the sheet pile 8 by a so-called suction head 18 which, among others, has a number of lifting and dragging suckers 19, 21 for separating the sheets 7. Furthermore, blast or blowing devices 22 for loosening up the top sheet layers, and sensing elements 23 for following up or tracking the pile or stack, are provided. A number of side and rear stops 24 are provided in order to align the sheet pile or stack 8, in particular the top sheets 7 of the sheet pile or stack 8.

Figure 2:
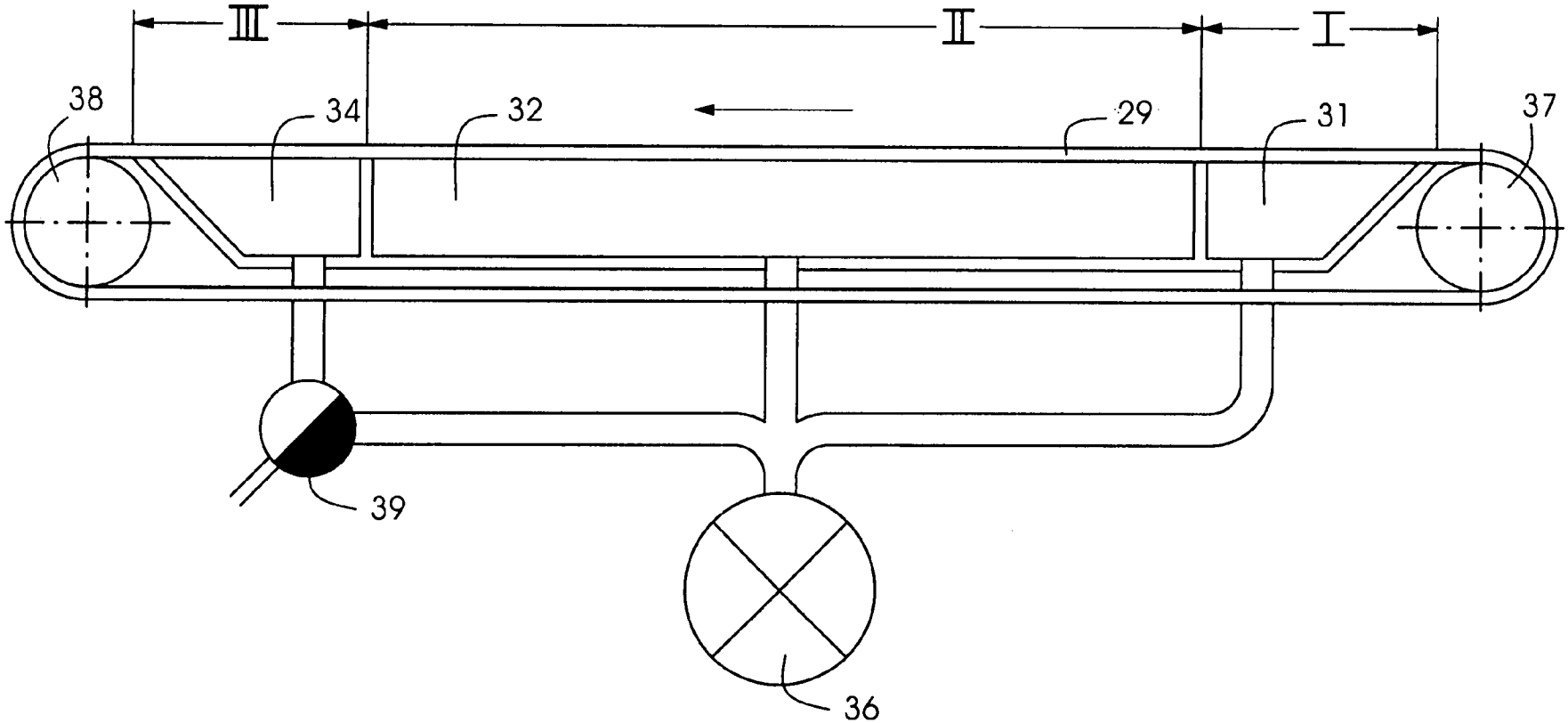
FIG. 2 is a fragmentary, side-elevational view of FIG. 1 showing an exemplary embodiment of a feeding table for sheets in a sheet feeder of the printing press.

The sheet arriving in a forward or front region of the feed table 9 is aligned in the direction of sheet transport by front guides 26 and, transversely to the direction of sheet transport, by lateral aligning elements 27. The feed table 9 is configured as a so-called suction belt table which, as viewed in the direction of sheet transport, has at least three suction regions I, II, III shown in FIG. 2. The first suction region I is distinguished by a high vacuum level, in order to be able to take over a sheet reliably from the separating device. The vacuum in the suction region I is produced by a suction box 31 which is disposed below a feed plane.

The second or middle suction region II is distinguished by a low vacuum level which exerts a relatively small holding force on the sheet in order to hold the latter sufficiently reliably on a transport belt 29. The vacuum in the second or middle suction region II is produced by two suction boxes 32 and 33, seen in FIG. 3. The suction boxes 32 and 33 are disposed in parallel at a distance from one another transversely with respect to the direction of sheet transport and, in fact, preferably in the edge region, i.e., near the respective side edges of the transport or suction belt 29.

The third or end suction region III is distinguished by a cyclic vacuum level. The vacuum in the suction region III is produced by a suction box 34 which is disposed below the feeding plane. All of the suction boxes 31, 32, 33 and 34 are connected to a single common suction source 36.

The transport belt 29 is driven by a drive roller 37 and deflected around a deflection roller 38. Tensioning devices provided for the transport belt 29 are not shown in the figures.

A rotary valve 39, providing a device for cycling the vacuum in the operating or work cycle of the sheet processing printing press, is connected in a connecting line to the suction box 34. The rotary valve 39 is additionally provided with a bypass to atmospheric pressure in order to adapt or adjust the vacuum of the suction box 34.

Figure 3:
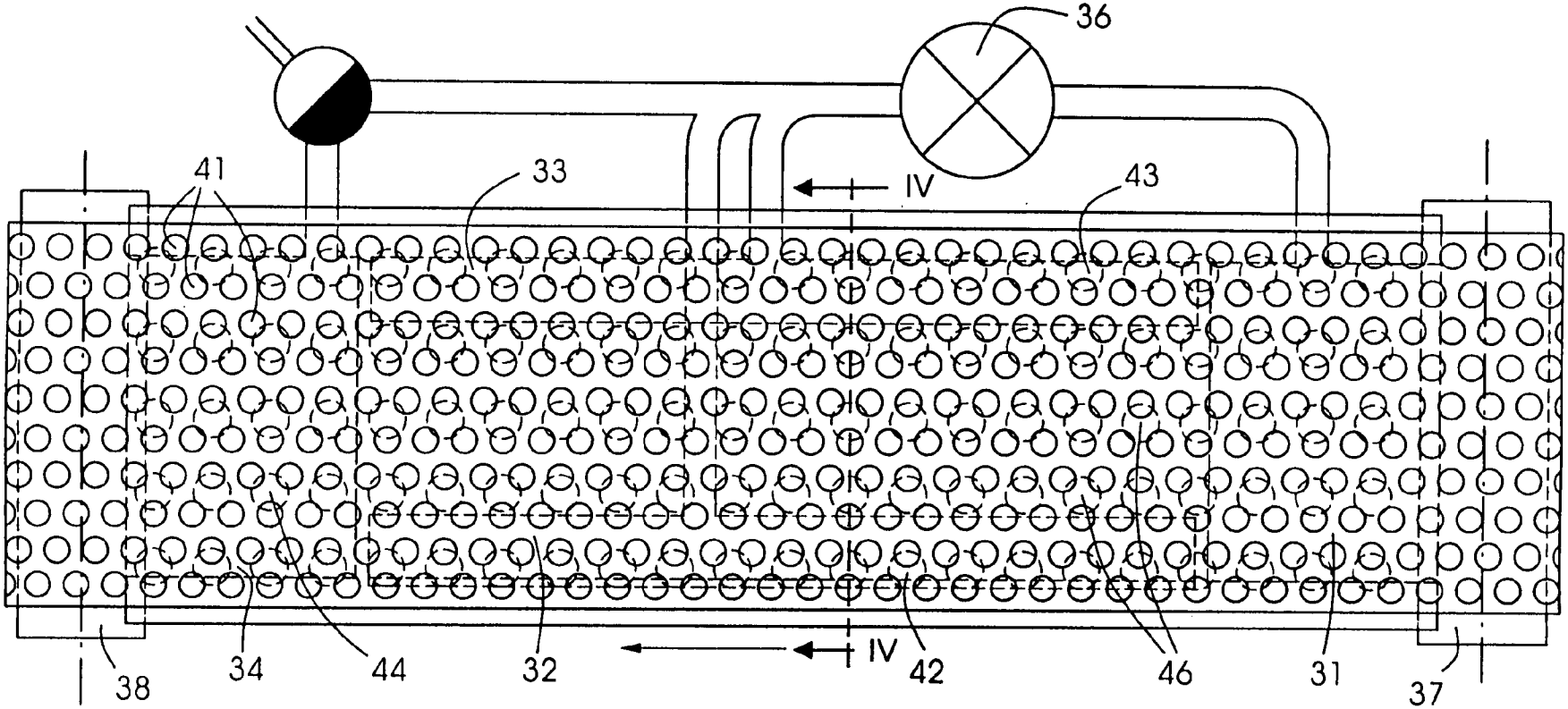
FIG. 3 is a plan view of the feeding table of FIG. 1.
Figure 4:
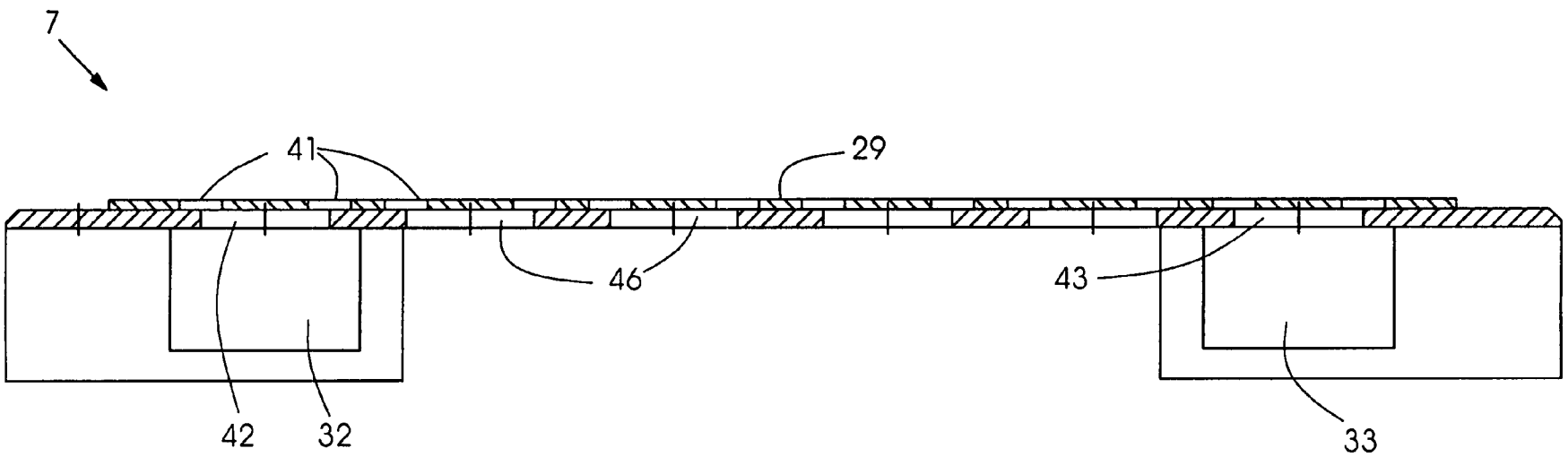
FIG. 4 is an enlarged, cross-sectional view of FIG. 3 taken along the line IV-IV through the feed table according to FIG. 2.

As is further shown in FIGS. 3 and 4, the transport belt 29 is formed with a multiplicity of through openings 41 which, in the suction region I, are connected to the suction box 31 by suction openings 42 formed in the feed table 9. In the suction region II, the through openings 41 in the edge regions of the transport belt 29 are connected to the respective suction boxes 32 and 33 by respective suction openings 42 and 43 formed in the feed table 9. Those through openings 41 formed in the middle region lying between the edge regions of the transport belt 29 are connected to atmospheric air by ventilation openings 46 formed in the feed table 9. In the suction region III, the through openings 41 are connected to the suction box 34 by suction openings 44 formed in the feed table 9.

Figure 5:
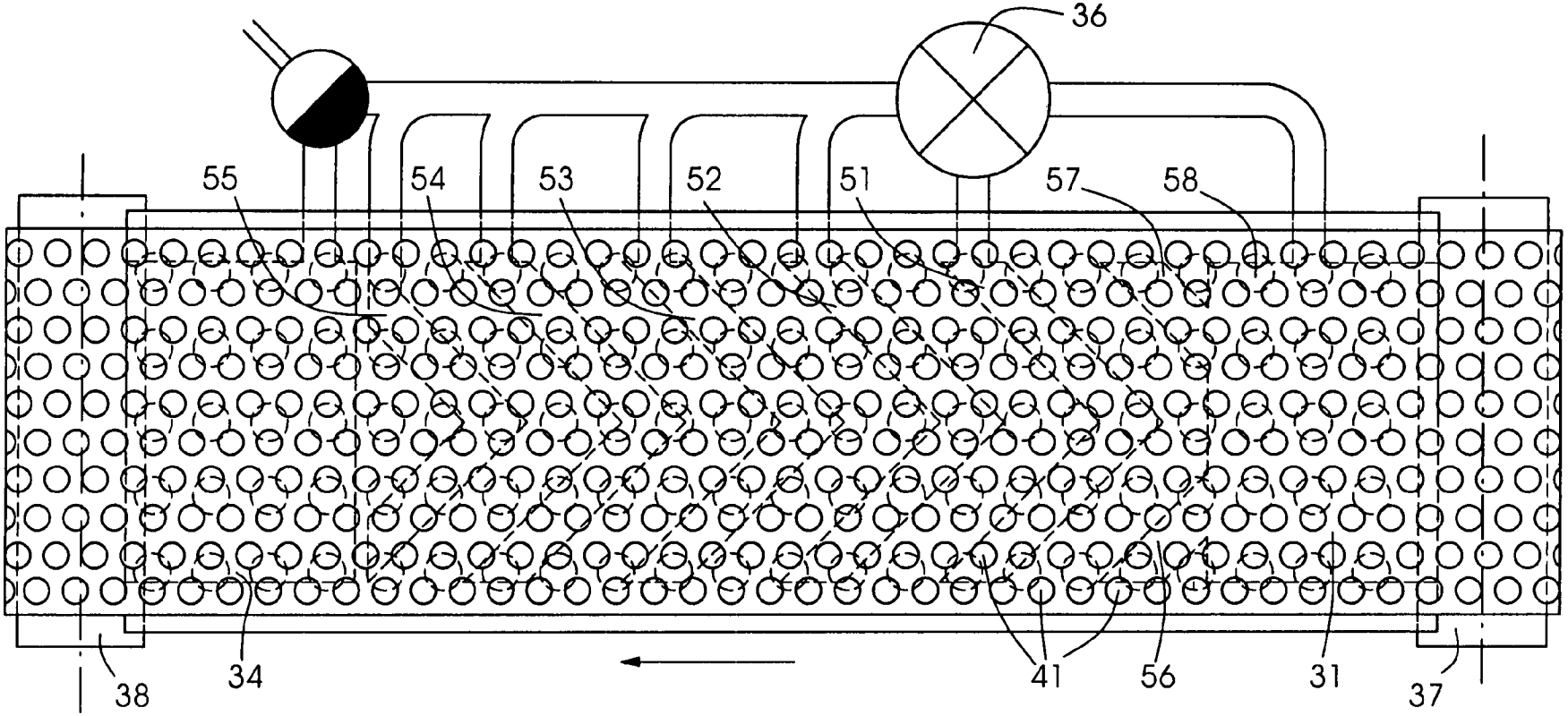
FIG. 5 is a plan view similar to FIG. 3 of a different exemplary embodiment of the feeding table.

In a second embodiment of the invention according to FIG. 5, provision is made for suction boxes 51 to 55 which are disposed in the middle suction region II to have a V-shaped configuration. The point of the V points counter to the direction of sheet transport. Through the use of this measure, a stretching of the transport belt 29 in the transverse direction and, additionally, a centering of the transport belt 29 are achieved.

The suction boxes 51 to 55 are respectively connected to the common suction source 36 and disposed at a regular distance from one another. It is also possible, in this way, for the suction box 31 to have suction box attachments 56, 57 which are adapted to or match the V shape.

Suction openings 58 which are appropriately disposed in a V shape and correspond with the through openings 41 formed in the transport belt 29 are provided in the feed table 9 in the region of the suction boxes 51 to 55. Ventilation openings 59 are provided in the feed table 9 between the suction openings 58 of the respective suction boxes 51 to 55 and 56, 57. Through the use of this measure, vacuum or atmospheric air is applied alternately to one and the same through hole 41 during transport, and reduces the holding force on the sheet or the stream of sheets with respect to the holding force thereon in the suction region I.

I claim:

1. A device for transporting sheets to a sheet processing machine, comprising:

a feed table defining suction regions of different pressure levels to be produced by a single vacuum source, said suction regions being disposed behind one another in a direction of sheet transport, and said feed table having suction openings and ventilation openings formed therein; and at least one suction belt for endlessly revolving over said feed table, said suction belt to be acted upon by said pressure levels, and said suction belt having through openings formed therein;

said suction openings openings in said feed table corresponding with said through openings in said suction belt, said ventilation openings in said feed table being in direct contact with said through openings in said suction belt.

2. The sheet-transporting device according to claim 1, wherein said suction regions include a second or middle suction region, and said suction openings and said ventilation openings are disposed said second or middle suction region.

3. The sheet-transporting device according to claim 1, further comprising suction boxes disposed in parallel in edge regions of said suction belt for acting upon said suction openings in said feed table.

4. The sheet-transporting device according to claim 1, further comprising suction boxes disposed behind one another in a V shape for acting with vacuum upon said suction openings in said feed table.

5. The sheet-transporting device according to claim 3, wherein said ventilation openings in said feed table are respectively disposed between said suction boxes.

6. The sheet-transporting device according to claim 4, wherein said ventilation openings in said feed table are respectively disposed between said suction boxes.

7. The sheet-transporting device according to claim 3, wherein said suction regions include an end suction region associated with one of said suction boxes, and a rotary valve connects said one suction box to said single vacuum source.

8. The sheet-transporting device according to claim 4, wherein said suction regions include an end suction region associated with one of said suction boxes, and a rotary valve connects said one suction box to said single vacuum source.

9. A device for transporting sheets to a sheet processing machine, the device comprising:

a feed table defining suction regions of different pressure levels, said suction regions being disposed behind one another in a direction of sheet transport, and said feed table having suction openings; and at least one suction belt for endlessly revolving over said feed table, said suction belt to be acted upon by said pressure levels, and said suction belt having through openings formed therein;

said suction openings corresponding with said through openings and being disposed in a V-shape for acting with vacuum upon said through openings.

10. The sheet-transporting device according to claim 1, wherein said feed table has a surface, said suction openings and said ventilation openings are formed in said surface.

11. The sheet-transporting device according to claim 1, wherein said ventilation openings connect corresponding ones of said through openings of said belt to atmospheric air.

* * * * *

UNITED STATES PATENT AND TRADEMARK OFFICE

CERTIFICATE OF CORRECTION

PATENT NO. : 7,293,770 B2
APPLICATION NO. : 10/785123
DATED : November 13, 2007
INVENTOR(S) : Holger Edinger It is certified that error appears in the above-identified patent and that said Letters Patent is hereby corrected as shown below:

Column 4,

Line 52, "said suction openings openings" should read -- said suction openings --

Signed and Sealed this

Twenty-sixth Day of February, 2008

JON W. DUDAS
*Director of the United States Patent and Trademark Office*